United States Patent [19]

Sengstaken

[11] Patent Number: 4,998,364

[45] Date of Patent: Mar. 12, 1991

[54] VISUAL DISPLAY AND AMUSEMENT DEVICE

[76] Inventor: David Sengstaken, 1 The Rise, Woodbury, N.Y. 11797

[21] Appl. No.: 302,785

[22] Filed: Jan. 30, 1989

[51] Int. Cl.[5] ..... G09F 19/08

[52] U.S. Cl. ..... 40/411; 40/414; 40/415; 272/31 A

[58] Field of Search ..... 272/31 R, 31 A, 31 B; 40/415, 215, 473, 411, 430, 414; 446/236, 265

[56] References Cited

U.S. PATENT DOCUMENTS

| | | | |
|---|---|---|---|
| 932,875 | 8/1909 | Lavallee | 40/411 |
| 1,593,720 | 7/1926 | Hanson | 40/411 |
| 1,912,513 | 6/1933 | Craig | 40/415 |
| 2,094,890 | 10/1937 | Hoyt | 40/215 |
| 2,135,606 | 11/1938 | Stuve | 40/411 |
| 2,434,250 | 1/1948 | Rubus | 40/411 |
| 2,715,530 | 8/1955 | Olsen | 272/31 R |
| 2,750,189 | 6/1958 | Huth | 272/31 A |
| 3,512,773 | 5/1970 | Jacobs | 272/31 B |
| 3,858,872 | 1/1975 | Summerfield et al. | 272/31 A |
| 4,174,105 | 11/1979 | Meyer et al. | 272/31 A |
| 4,641,445 | 2/1987 | Rossi | 40/430 |
| 4,817,311 | 4/1989 | Ong | 40/406 |

FOREIGN PATENT DOCUMENTS

| | | | |
|---|---|---|---|
| 1123908 | 6/1956 | France | 272/31 R |

*Primary Examiner*—Kenneth J. Dorner
*Assistant Examiner*—Brian K. Green
*Attorney, Agent, or Firm*—Michael I. Kroll

[57] ABSTRACT

A visual display and amusement device is provided which will give an illusion that a miniature airplane model is pulling a curved banner with a message thereon about an upper transparent portion of a housing. The device will convey the message over and over again to a person viewing the device.

7 Claims, 2 Drawing Sheets

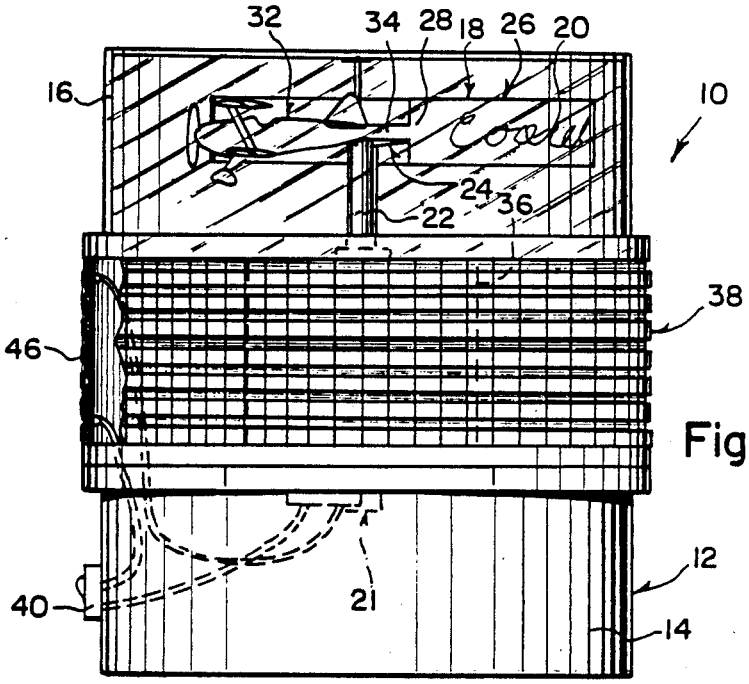
Fig. 3
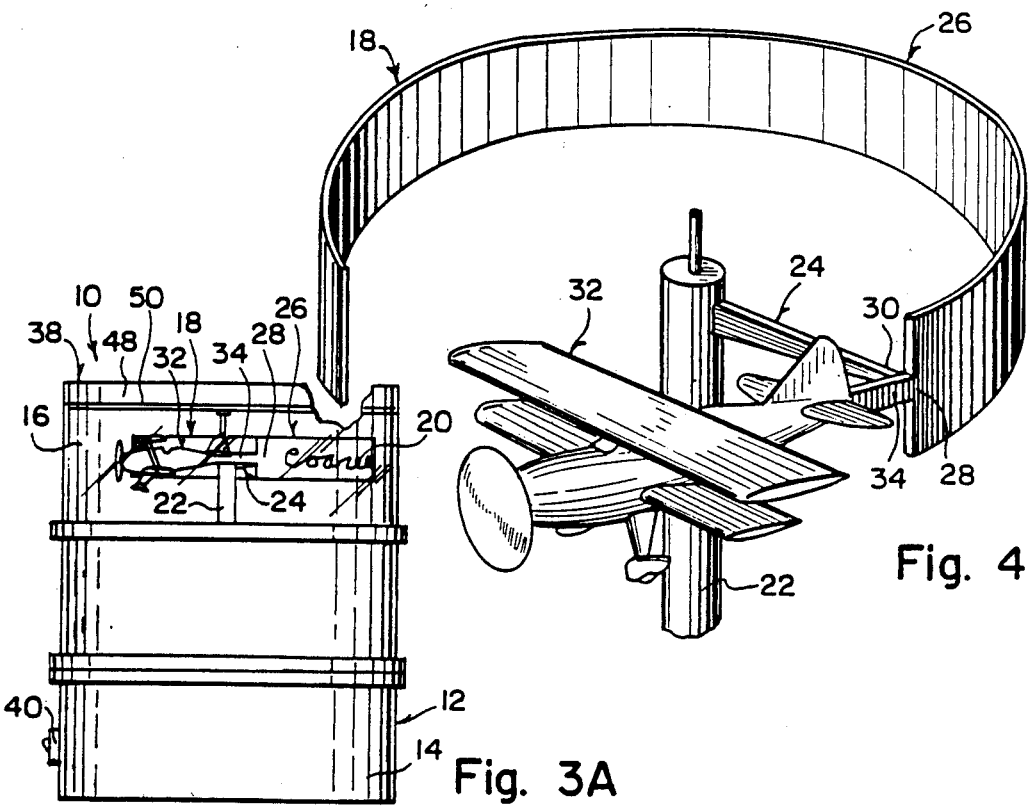
Fig. 4
Fig. 3A

VISUAL DISPLAY AND AMUSEMENT DEVICE

BACKGROUND OF THE INVENTION

1. Field of the Invention

The instant invention relates generally to sight pleasing apparatuses and more specifically it relates to a visual display and amusement device.

2. Description of the Prior Art

Numerous sight pleasing apparatuses have been provided in prior art that are adapted to perform various tasks which can cause relaxing sensations to people who look at the apparatuses. While these units may be suitable for the particular purpose to which they address, they would not be as suitable for the purposes of the present invention as heretofore described.

SUMMARY OF THE INVENTION

A primary object of the present invention is to provide a visual display and amusement device that will overcome the shortcomings of the prior art devices.

Another object is to provide a visual display and amusement device which will convey a message over and over again to a person viewing the device.

An additional object is to provide a visual display and amusement device in which rotation of a portion of the device that contains the message will please and remove tension from a person viewing the device.

A further object is to provide a visual display and amusement device in which the rotational portion of the device will be a miniature airplane model with a curved banner having the message thereon extending behind the airplane model.

A still further object is to provide a visual display and amusement device that includes a hidden motor which will cause the miniature airplane model and curved banner to rotate thereabout.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 3 is an elevational view with parts broken away and in section of a second modification of the invention that includes a solar panel located about middle of the housing.

FIG. 3A is an elevational view of a third modification of the invention in which the solar panel is located on top surface of housing.

FIG. 4 is a perspective view of the motor shaft, miniature airplane model and curved banner in greater detail.

DETAILED DESCRIPTION OF THE PREFERRED EMBODIMENTS

Figure 1:
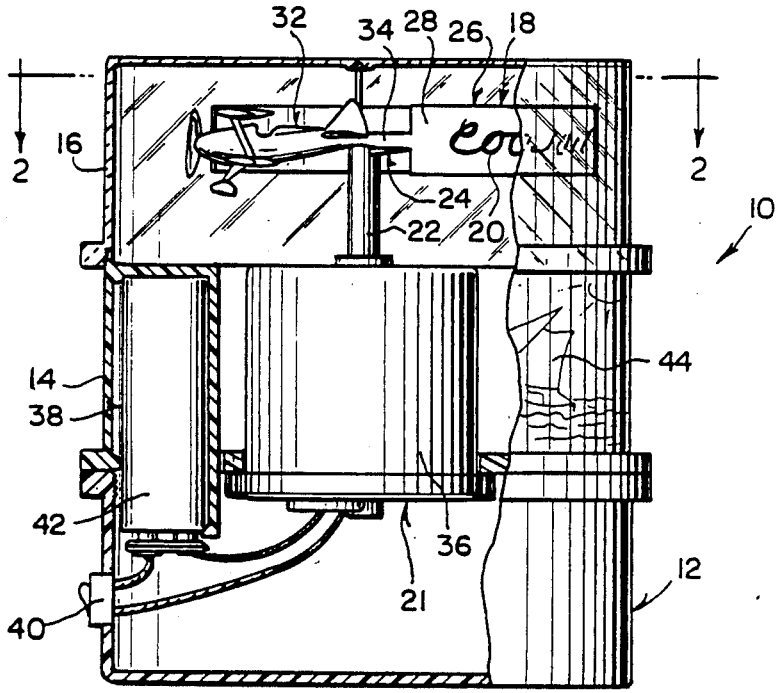
FIG. 1 is an elevational view with parts broken away and in section of the invention.

Turning now descriptively to the drawings, in which similar reference characters denote similar elements throughout the several views, FIGS. 1 through 4 illustrate a visual display and amusement device 10. A housing 12 is provided having a lower portion 14 and an upper transparent portion 16. A mechanism 18 is located in the upper transparent portion 16 of the housing 12 for holding a message 20. A mechanism 21 is located in the lower portion 14 of the housing 12 below the upper transparent portion 16 for causing the holding mechanism 18 to rotate, thus conveying the message 20 over and over again to a person viewing the device 10.

The holding mechanism 18 includes a rotatable vertical shaft 22 that extends upwardly into the upper transparent portion 16 of the housing 12. A horizontal arm 24 is connected to and extends away from upper end of the shaft 22. A curved banner 26 having the message 20 thereon is affixed transversely at front portion 28 to distal end 30 of the arm 24. A miniature airplane model 32 has a tail extension portion 34 affixed to the front portion 28 of the banner 26, so that when the shaft 22 rotates it will give an allusion that the miniature airplane model 32 is pulling the banner 26 in a circular movement about the upper transparent portion 16 of the housing 12 which will please and remove tension from a person viewing the device 10.

The rotating mechanism 21 includes an electric motor 36 coupled to the shaft 22. The motor 36 is secured within the lower portion 14 of the housing 12 below the upper transparent portion 16, while power source 38 is carried by the housing 12. A switch 40 is secured to the lower portion 14 of the housing 12 below the upper transparent portion 16 and is electrically connected between the motor 36 and the power source 38 so that a person can manually turn the switch 40 on and off to operate the motor 36 when needed.

Figure 2:
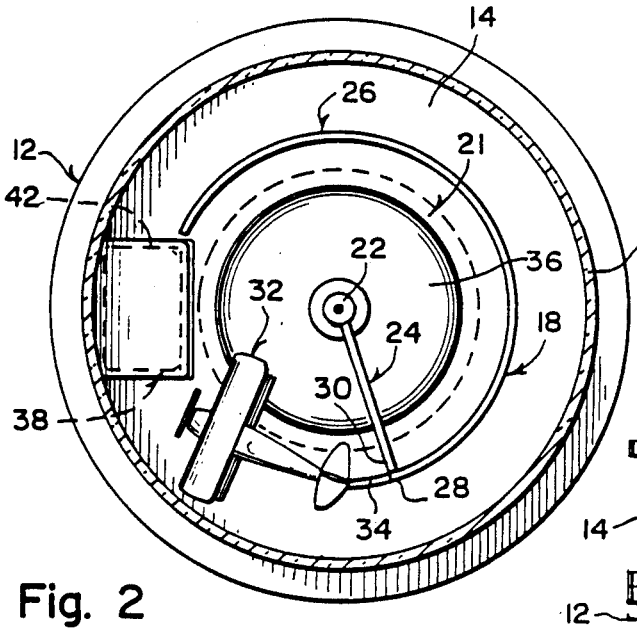
FIG. 2 is a cross sectional view taken along line 2—2 in FIG. 1.

The power source 38 as shown in FIGS. 1 and 2 is a battery 42 secured within the lower portion 14 of the housing 12. The housing 12 can be cylindrical in shape and have pictures of scenery 44 located on the lower portion 14 thereof.

The power source 38 as shown in FIG. 3, is a solar panel 46 located on the lower portion 14 of the housing 12 which is about the middle thereof. The power source 38 as shown in FIG. 3A is a solar panel 48 located on top surface 50 of the upper transparent portion 16 of the housing 12.

Figure 1A:
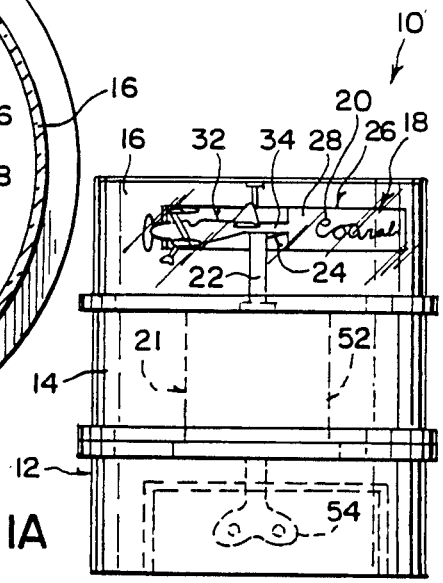
FIG. 1A is an elevational view of a first modification that includes a wind-up motor.

The rotating mechanism 21 as shown in FIG. 1A is a spring actuated motor 52 coupled to the shaft 22. The motor 52 is secured within the lower portion 14 of the housing 12. A key 54 extends from the motor 52 through the lower portion 14 of the housing 12 so that a person can wind-up the motor 52 when needed.

LIST OF REFERENCE NUMBERS

10 visual display and amusement device
12 housing
14 lower portion of housing
16 upper transparent portion of housing
18 holding mechanism
20 message
21 rotating mechanism
22 rotatable vertical shaft
24 horizontal arm
26 curved banner 28 front portion of banner
30 distal end of arm
32 miniature airplane model
34 tail extension portion
36 electric motor
38 power source
40 switch
42 battery
44 pictures of scenery
46 solar panel
48 solar panel
50 top surface
52 spring actuated motor
54 key It will be understood that each of the elements described above, or two or more together, may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A visual display and amusement device, comprising:

(a) a housing having a cylindrically-shaped lower portion and a cylindrically-shaped upper transparent portion, said cylindrically-shaped upper transparent portion being mounted on top of said cylindrically-shaped lower portion;

(b) means located in said upper transparent portion of said housing for holding a message, said holding means include a rotatable vertical shaft having a horizontal arm connected to and extending away from an upper end of said rotatable vertical shaft, said horizontal arm is directly connected at one end to a curved banner that has the message affixed transversely thereon, said curved banner is rigid and is directly mounted to a miniature airplane model without the use of ropes and illumination, said airplane model and said curved banner being connected so that when said vertical shaft rotates it will give an illusion that said airplane model is pulling said banner in a constant sized circular movement about said upper transparent portion of said housing; and a rotating means located in said lower portion of said housing including a motor which is coupled to said rotatable vertical shaft for rotation of said holding means to convey the message on said curved banner.

2. A device as recited in claim 1, wherein said rotating means includes:

(a) said motor coupled to said vertical shaft is an electric motor, said motor secured within the lower portion of said housing below the upper transparent portion;

(b) a power source carried by said housing; and (c) a switch secured to the lower portion of said housing below the upper transparent portion and electrically connected between said motor and said power source so that a person can manually turn said switch on and off to operate said motor when needed.

3. A device as recited in claim 2, wherein said power source is a vertically disposed battery secured within the lower portion of said housing.

4. A device as in claim 3, wherein said housing is cylindrical in shape and having pictures of scenery located on the lower portion thereof.

5. A device as recited in claim 2, wherein said power source is a solar panel located on the lower portion of said housing which is about the middle thereof.

6. A device as recited in claim 2, wherein said power source is a solar panel located on a top surface of the upper transparent portion of said housing.

7. A device as recited in claim 1, wherein a spring actuated rotating means includes:

(a) a spring actuated motor coupled to said vertical shaft is a spring actuated motor, said motor secured within the lower portion of said housing; and (b) a key extending from said motor through the lower portion of said housing so that a person can wind-up said motor when needed.

* * * * *